United States Patent [19]

Maeda

[11] 4,194,377

[45] Mar. 25, 1980

[54] LOCKING MEANS FOR AUTOMOBILE DOORS

[75] Inventor: Tatsuo Maeda, Hiroshima, Japan

[73] Assignee: Toyo Kogyo Co., Ltd., Hiroshima, Japan

[21] Appl. No.: 935,867

[22] Filed: Aug. 22, 1978

[30] Foreign Application Priority Data

Aug. 24, 1977 [JP] Japan ..... 52/114006[U]

[51] Int. Cl.[2] ..... E05B 17/00; E05B 33/00; E05C 3/06

[52] U.S. Cl. ..... 70/360; 292/216; 70/380

[58] Field of Search ..... 70/135, 137, 139, 237, 70/240, 241, 360, 380, DIG. 79, 150; 292/210, 216

[56] References Cited

U.S. PATENT DOCUMENTS

| | | | |
|---|---|---|---|
| 2,793,898 | 5/1957 | Roethel | 70/135 |
| 3,785,186 | 1/1974 | James | 70/240 |
| 3,964,280 | 6/1976 | Kelton | 70/360 |
| 4,073,170 | 2/1978 | Miyabayashi, et al. | 70/256 |

*Primary Examiner*—Robert L. Wolfe
*Attorney, Agent, or Firm*—Fleit & Jacobson

[57] ABSTRACT

Automobile door lock assembly of push-button type including a rotatable element axially movable with a push-button and an annular element co-axial with the rotatable element. The rotatable element is formed with an axially extending slot having a shoulder defined by a wide and narrow portions of the slot. The annular element has a lug adapted to be placed in the slot of the rotatable element so that, when the lug is placed in the position engageable with the shoulder, the axial movement of the rotatable element is prohibited but, when the rotatable element is rotated to place the lug out of the path of the shoulder, the axial movement of the rotatable element is allowed to release the latch in the lock assembly. The annular element has manually actuatable lever so that it can be actuated into locking position without using a key.

6 Claims, 7 Drawing Figures

LOCKING MEANS FOR AUTOMOBILE DOORS

The present invention relates to locking means for automobile doors and more particularly to push-button type locking means.

Push-button type locking means is widely adopted in rear door assemblies of automobiles. Conventional locking means of this type has been found inconvenient in that locking and unlocking operations are performed only through the use of a key. It has therefore been required, in order to lock the door while the engine is being operated, to stop the engine for removing the key from the engine key switch assembly and use the key for locking the door.

It is therefore an object of the present invention to provide push-button type locking means for automobile doors which can be brought into locking position without using a key.

Another object of the present invention is to provide push-button type locking means having a manually operated locking means which can be manually actuated into locking position only when the automobile door is in open position.

According to the present invention, in order to accomplish the above and other objects, there is provided push-button type locking means for automobile doors which comprises pivotable latching means movable between a latching position wherein it is in latching engagement with striker means and an unlatching position wherein it is disengaged from said striker means, means for biasing said latching means into the unlatching position, claw means movable between an operative position wherein it is engaged with the latching means so as to hold the latching means in the latching position and an inoperative position wherein it releases the latching means so as to allow the latching means to move under the biasing force of the biasing means into the unlatching position, a lock body carrying push-button means for axial movement with respect thereto, said push-button means including rotatable means having a portion adapted to engage when the push-button means is axially depressed to cause the axial movement thereof with said claw means to force the latter into the inoperative position, swingable lever means having a manually actuatable portion, said rotatable means having abutting means adapted to engage with cooperative abutting means on said lever means to prevent the axial movement of the push-button means, said lever means being movable between a locking position wherein the abutting means on the lever means engages with the abutting means on the rotatable means to prevent the axial movement of the pushbutton means and an unlocking position wherein said abutting means on said lever means is retracted to allow the axial movement of the push-button, said rotatable element being provided with means engageable with said lever means to rotate, when the push-button means is rotated by the key in unlocking direction, the lever means into the unlocking position.

According to the present invention, the swingable lever means can be manually actuated into the locking position when the door is in open position so that the door can be locked upon closing the door. Preferably, the lever means is so located that the manually actuable portion is positioned between the door and a stationary part of automobile body when the door is closed. In this arrangement, the lever means is manually actuatable only when the door is opened. The present invention is particularly suitable for application to a rear door assembly of an automobile but may also be applied to locking means for other automobile doors.

The above and other objects and features of the present invention will become apparent from the following descriptions of preferred embodiments taking reference to the accompanying drawings, in which;

FIG. 6 (III) shows the lever element in inoperative position; and,

Figure 1:
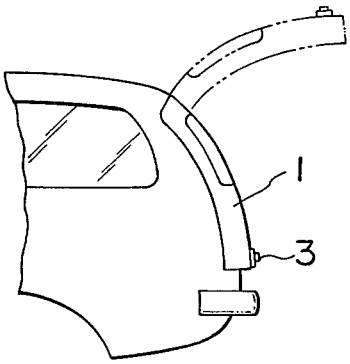
FIG. 1 is a fragmentary side view showing the rear portion of an automobile having a rear hatch door.
Figure 2:
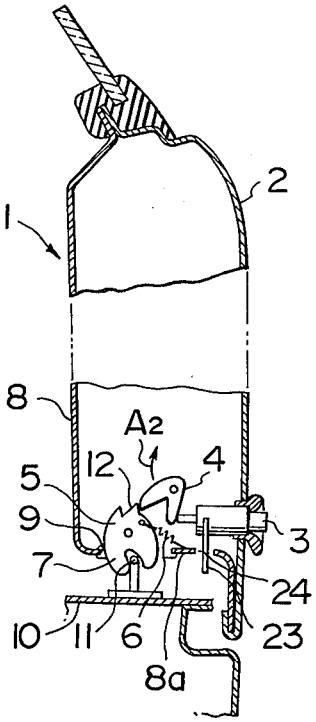
FIG. 2 is a fragmentary sectional view showing the locking mechanism adopted in the rear door.

Referring now to the drawings, particularly to FIGS. 1 and 2, the automobile shown therein has a body provided with a rear hatch door assembly 1 which is hinged to the body at the upper edge thereof. As shown in FIG. 2, the door assembly 1 is comprised of an outer panel 2 and an inner panel 8. The door assembly 1 is provided with a locking mechanism for locking the door assembly 1 in the closed position.

The locking mechanism includes a latching element 5 pivotably mounted on the inner panel 8 of the door assembly 1 through a suitable bracket (not shown). The latching element 5 has a bifurcated latching finger 7 projecting outwardly through an aperture 9 in a lower land portion 8*a* of the inner panel 8 for engagement with a striker 11 provided on a floor 10 of the automobile at a portion confronting to the lower land portion 8*a*. The latching element 5 is movable between a latching position in which the latching finger 7 is in latching engagement with the striker 11 and an unlatching position in which it is disengaged from the striker 11. A spring 6 is provided for biasing the latching element 5 into the unlatching position.

On the door assembly 1, there is also mounted a claw lever 4 which is pivotable between an operative position in which it engages with ratchet teeth 12 on the latching element 5 to hold the latter in the latching position and an inoperative or releasing position in which it is disengaged from the latching element 5 so as to allow the latter to move under the force of the spring 6 into the unlatching position. Although not shown in the drawings, the claw lever 4 is spring biased so that it is normally maintained in the operative position.

Figure 3:
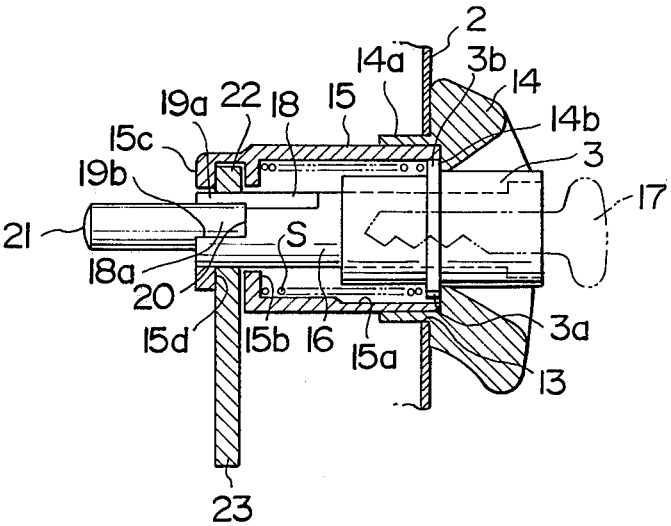
FIG. 3 is a sectional view of the locking mechansim particularly showing the push-button device in the mechanism.

In order to move the claw lever 4 into the inoperative position so that the latching element 5 is released and allowed to move into the unlatching position, there is provided a push-button assembly which includes, as shown in FIG. 3, a handle element 14 secured to the outer panel 2 of the door assembly 1 and a cylindrical lock body 15 secured to the handle 14. In the lock body 15, there is disposed a push-button 3 which has a radially projecting key 3*a* formed on an annular flange 3*b*. The key 3*a* is in slidable engagement with a longitudinally extending key groove 15*a* formed in the cylindrical body 15 so that the push-button 3 is movable in the axial direction but not rotatable. In the lock body 15, there is also disposed a spring S which acts between the annular flange 3*b* on the push-button 3 and an annular spring seat 15*b* formed in the lock body 15. Thus, the push-button 3 is normally maintained in the axially projected position wherein the flange 3*b* on the push-button 3 is in abutting engagement with a stopper surface 14*b* on the handle 14 as shown in FIG. 3 but can be depressed in leftward direction as seen in the plane of FIG. 3.

In the push-button 3, there is mounted a rotating element 14 which is rotatable but not axially movable with respect to the push-button 3. Although not shown in FIG. 3, a torsion spring is provided between the push-button 3 and the rotating element 14 so that the element 14 is biased in one angular direction. The element 14 has a key hole adapted to receive a key 17 so that it can be rotated against the action of the torsion spring by means of the key 17.

Figure 4:
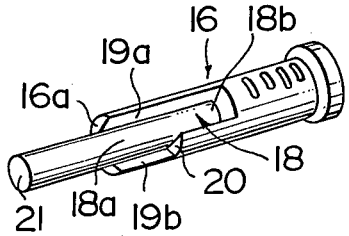
FIG. 4 is a perspective view showing a rotatable element associated with the push-button.
Figure 5:
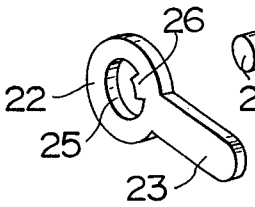
FIG. 5 is a perspective view of a swingable lever element adapted to cooperate with the rotatable element shown in FIG. 4.

The rotating element 16 is extending beyond the inner end of the push-button 3 and, as shown in FIG. 4, is formed with a slot 18 defined by opposing walls 19*a* and 19*b*. The slot 18 has a wide portion 18*a* and a narrow portion 18*b* so that a shoulder 20 is formed between the portions 18*a* and 18*b* at the side of the wall 19*b*. The rotating element 16 has a push-rod 21 which extends beyond the inner end 16*a* and is adapted to engage with the claw lever 4.

The lock body 15 further carries a swingable lever 23 which has at one end an annular base 22 mounted on the body 15 coaxially with respect to the push-rod 16. The base 22 of the lever 23 has a substantially circular hole 25 and a radially inwardly projecting lug 26. The inner end portion of the rotating element 16 extends through the hole 25 in the base 22 of the lever 23 with the lug 20 positioned in the slot 18. As shown in FIG. 2, the free end of the lever 23 is extending through an aperture 24 in the land portion 8*a* of the door inner panel 8 which faces to the floor 10 in the automobile body when the door 1 is closed. Therefore, the lever 23 can be manually actuated only when the door 1 is in open position. The lug 26 has a width slightly smaller than that of the narrow portion 18*a* of the slot 18 so that, when the lug 26 is in a position confronting to the shoulder 20 of the element 16, the axial movement of the element 16, the axial movement of the element 16 is restricted but, when the lug 26 is moved to a position aligned with the narrow portion 18*a* of the slot 18, the element 16 becomes free to move in the axial direction. Therefore, the first position of the lug 26 or the 23 lever may be referred as the locking position and the second position as the unlocking position. The lever 23 can be moved between the locking and unlocking positions by rotating the element 16 since either the wall 19*a* or 19*b* engages the lug 26 to cause the rotation of the lever 23.

Figure 6:
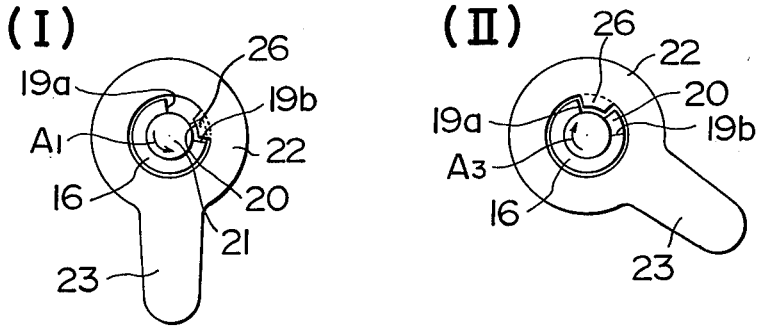
FIG. 6 (I) shows the lever element in operative position.

Referring now to FIG. 6, the push-button assembly is shown in the locking position in FIG. 6(I). In this position, the lever 23 is in the position wherein the lug 26 engages the shoulder 20 of the element 16. To unlock the door, the key 17 is inserted into the key hole in the element 16 and the element 16 is rotated in the direction shown by an arrow $A_1$ and FIG. 6(I). Then, the lug 26 on the lever 23 is engaged with the wall 19*b* and the lever 23 is thus rotated in the same direction to the position shown in FIG. 6(II).

As soon as the actuating force on the key 17 is removed, the rotating element 16 is returned to the original position so that the lug 26 is aligned with the narrow portion 18*b* of the slot 18. The push-button 3 is then depressed to cause the push-rod 21 engage the claw lever 4 to actuate the latter into the inoperative or release position as shown by an arrow $A_2$ in FIG. 2. Thus, the latch element 5 is released and moved under the bias force of the spring 6 into the unlatching position.

When it is desired to lock the door without using the key 17, the lever 23 is manually actuated from the position shown in FIG. 6(II) to the position shown in FIG. 6(I) and the door is closed. Then, the finger 7 on the latching element 5 is brought into engagement with the striker 11 and held in position by the claw lever 4 which engages the ratchet teeth 12 on the element 5.

In order to lock the door by using the key 17, the door 1 is at first closed with the lever 23 maintained in the position as shown in FIG. 6(II). Then, the latching element 5 is engaged with the striker 11 and maintained in the position by the claw lever 4. Thereafter, the key 17 is inserted into the key hole in the rotating element 16 and the element 16 is rotated in the direction shown by an arrow $A_3$ in FIG. 6(II). The lever 23 is then rotated in the same direction through the engagement between the wall 19*a* and the lug 26 to bring the lug 26 engageable with the shoulder 20 on the element 16.

Figure 7:
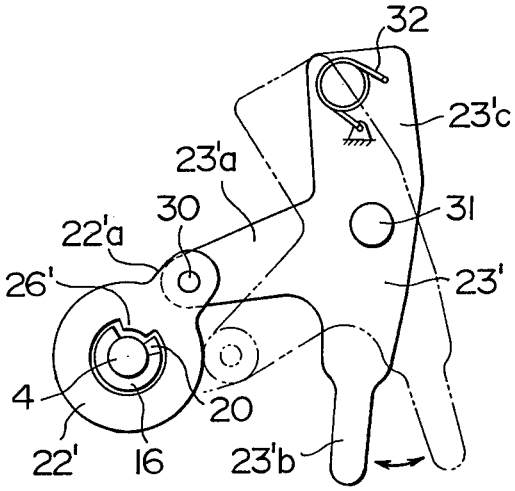
FIG. 7 shows an alternative embodiment of the swingable lever means.

Referring to FIG. 7, there is shown another embodiment of the swingable lever. In this embodiment, the lever is divided into a circular base element 22' and a lever element 23' which are connected together by a pivot pin 30 at arm portions 22'*a* and 23'*a* respectively formed on the elements 22' and 23'. The lever element 23' is of substantially T-shaped configuration and pivotably mounted on the door by means of a pin 31. The downwardly extending leg 23'*b* of the element 23' is projecting out of the door so that it can be manually actuated. On the upwardly extending leg 23'*c*, there is provided an overcenter spring 32 which provides the lever mechanism with two stable positions as shown by solid and broken lines in FIG. 7. The solid line shows the base and lever elements 22' and 23' in the unlocking position while the broken line shows the elements in the locking position.

As in the previous embodiment, the lever element 23 can be manually actuated from the unlocking position to the locking position so as to bring the lug 26' on the base element 22' into a position engageable with the shoulder 20 on the rotating element 16. The elements 22' and 23' can further be moved between the locking and unlocking positions by means of a key which is adapted to be inserted into the rotating element 16.

It is of course within the scope of the present invention to provide the walls 19*a* and 19*b* for rotating the lever 23 and the shoulder 20 for restricting the axial movement of the rotating element 16 in different parts. Further, the striker may be mounted on the door and the latching mechanism on the automobile body.

The invention has thus been shown and described with reference to specific embodiments, however, it should be noted that the invention is in no way limited to the details of the illustrated structures but changes and modifications may be made without departing from the scope of the appended claims.

I claim:

1. Push-button type locking means for automobile doors comprising pivotable latching means movable between a latching position wherein it is in latching engagement with striker means and an unlatching position wherein it is disengaged from said striker means, means for biasing said latching means into the unlatching position, claw means movable between an operative position wherein it is engaged with the latching means so as to hold the latching means in the latching position and an inoperative position wherein it releases the latching means so as to allow the latching means to move under the biasing force of the biasing means into the unlatching position, a lock body carrying push-button means for axial movement with respect thereto, said push-button means including rotatable means having a portion adapted to engage when the push-button means is axially depressed to cause the axial movement thereof with said claw means to force the latter into the inoperative position, swingable lever means having a manually actuable portion, said rotatable means having abutting means adapted to engage with cooperative abutting means on said lever means to prevent the axial movement of the push-button means, said lever means being movable between a locking position wherein the abutting means on the lever means engages with the abutting means on the rotatable means to prevent the axial movement of the push-button means and an unlocking position wherein said abutting means on said lever means is retracted to allow the axial movement of the push-button, said rotatable element being provided with means engageable with said lever means to rotate, when the push-button means is rotated by the key in unlocking direction, the lever means into the unlocking position.

2. Locking means in accordance with claim 1 in which said lever means is so located that the manually actuatable portion is positioned between the door and a stationary part of automobile body when the door is closed.

3. Locking means in accordance with claim 1 in which said lever means includes annular base means having opening through which said rotatable means extends and the abutting means on the lever means is in the form of lug means projecting radially inwardly into the opening of the base means, said rotatable means being provided with slot means for receiving said lug means and said abutting means on the rotatable means is in the form of shoulder means formed in the slot means.

4. Locking means in accordance with claim 3 in which said lever means has a lever portion constituting the manually actuatable portion and movable as a unit with the base means.

5. Locking means in accordance with claim 3 in which said lever means has a lever portion constituting the manually actuatable portion and pivotably connected with said base means, bi-stable means provided on the lever portion to provide said lever means with stability both in the locking and the unlocking positions.

6. locking means in accordance with claim 1 in which said push-button means and the lever means are mounted on the door, and the manually actuatable portion on the lever means extends out of the door.

* * * * *